United States Patent [19]

Johnson

[11] 3,986,220

[45] Oct. 19, 1976

[54] SHARK SCREEN

[76] Inventor: Clarence S. Johnson, 4444 W. Point Loma Blvd., San Diego, Calif. 92107

[22] Filed: July 7, 1975

[21] Appl. No.: 594,137

[52] U.S. Cl. ..... 9/311

[51] Int. Cl.[2] ..... B63C 9/16

[58] Field of Search ..... 9/11 A, 14, 311, 329, 9/330, 331

[56] References Cited

UNITED STATES PATENTS

| | | | |
|---|---|---|---|
| 1,256,488 | 2/1918 | Smith | 9/330 |
| 1,361,210 | 12/1920 | Wheeler | 9/331 |
| 3,155,992 | 11/1964 | Shewmake et al. | 9/11 A |
| 3,222,701 | 12/1965 | Fest | 9/330 |
| 3,428,978 | 2/1969 | Johnson | 9/330 |
| 3,477,074 | 11/1969 | Bezanis | 9/311 |
| 3,808,831 | 5/1974 | Landry | 9/11 A |

*Primary Examiner*—Trygve M. Blix
*Assistant Examiner*—Jesus D. Sotelo
*Attorney, Agent, or Firm*—Richard S. Sciascia; Ervin F. Johnston; Thomas Glenn Keough

[57] ABSTRACT

An improved shark screen reduces the possibility of a survivor of a shipwreck or air disaster from being attacked by sharks. A thin film bag is vacuum packed and stored in a cigarette package sized container. After it is unfolded and filled with water, the disaster victim crawls inside. A small inflated annular chamber at the top of the bag ensures that it remains in an upright position and presents an even protuberance-free surface. The top is closed by a drawstring to lower the screen's above-water profile and hides its occupant.

1 Claim, 3 Drawing Figures

SHARK SCREEN

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION

It is known that sharks are attracted to blood, motion or irregularly shaped objects at the water's surface. The presence of any or all of these indicates that an injured or helpless prey is near at hand and that attack is imminent. Shipwreck and air disaster victims are particularly vulnerable so that means have been designed to conceal such survivors. A dark bag-like object has been found to provide a degree of protection for a disaster victim and at least two noteworthy designs have evolved. The first is disclosed in the U.S. Pat. No. 3,222,701 to an Andre Fest in his invention entitled "Life Buoys." This design concerned itself with providing an elongate sheath supported by a cork ring which was to be thrown from a rescue craft to a shipwrecked person. An opening in the bottom, however, allowed body fluids, such as blood, urine or vomit, to flow from the bag and attract sharks drawn to the scene. Also, since the cork ring was open, the victim might be seen by the sharks as the ring bobbed on the surface. The bulk of the cork ring, elongate sheath and rings prevented it from being carried in the limited confines of an aircraft or on the person for immediately deployment when an emergency arose. A more compact design is shown in the U.S. Pat. No. 3,428,978 to the present inventor, C. S. Johnson. His "shark Screen" assumed the shape of an elongate tube supported by several side by side hollow compartments. Here again, however, since the compartments and elongate tube could not be folded into a small enough size to be easily carried on the person, this screen was restricted to use where adequate auxiliary storage spaces were available. The open top might, on occasion, reveal an occupant in rough seas and the several side by side compartments protruding above the water surface would react with surface winds. Thus, there is a continuing need in the state of the art for a shark screen which prevents the escape of body fluids while it conceals a victim and is compact enough to be capable of easily being carried on the person.

SUMMARY OF THE INVENTION

The present invention is directed to providing shark screen fabricated from a lightweight material to facilitate its being vacuum packed and carried on the person. A single small annular chamber is mounted near the mouth of the screen to provide sufficient buoyancy and outward force to maintain the screen in an upright distended configuration. A drawstring and panel ensure concealment of a disaster victim and the screen's overall dull coloring and protuberance-free profile do not attract sharks.

A prime objection of the invention is to provide an improved shark screen.

Another object of the invention is to provide a shark screen which is small enough to be conveniently carried on the person.

Yet another object of the invention is to provide a shark screen which is readily deployable to counter the threat imposed by menacing sharks.

Still another object of the invention is to provide a shark screen which does not present an overly large profile above the water's surface.

A further object of the invention is to provide a shark screen which forms a fluid shield between the disaster victim and the ambient water.

These and other objects of the invention will become more readily apparent from the ensuing description when taken with the drawings.

DESCRIPTION OF THE PREFERRED EMBODIMENT

Figure 1:
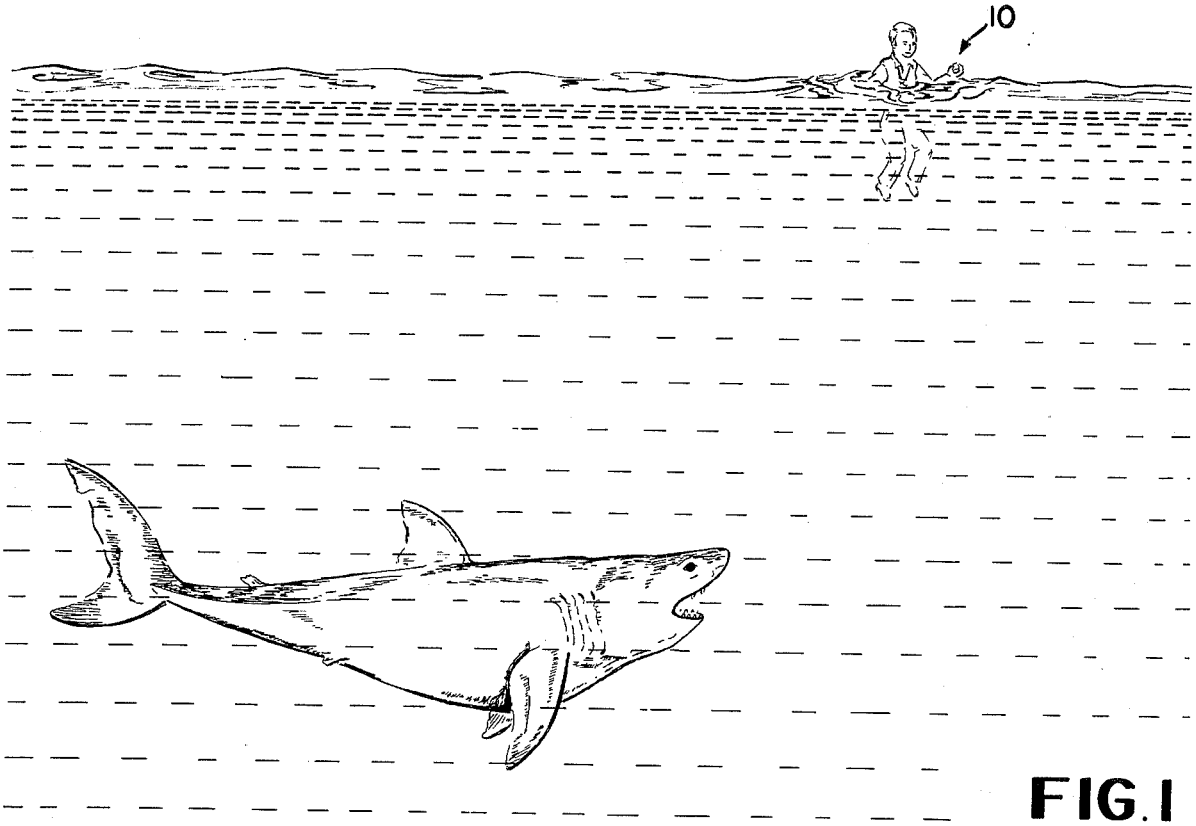
FIG. 1 depicts a disaster victim in an emergency situation.
Figure 2:
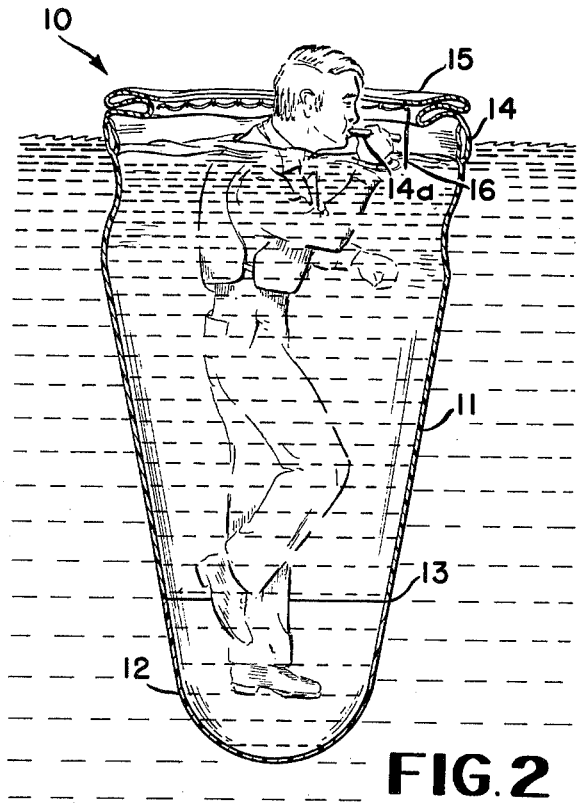
FIG. 2 shows the improved shark screen during deployment.

Referring now to FIG. 1 of the drawings, a shipwreck or air disaster victim is floating on the ocean's surface and in a state of imminent peril. Although it is common knowledge that flailing arms and legs create low frequency vibrations which invite attack, even when the victim is motionless, the outstretched limbs invite investigation by a large and aggressive shark. Particularly if the victim is injured during a mishap, blood from wounds or natural body secretions have attracted such large predators. Thus, for the purposes of presenting a protuberance-free surface, hiding a victim from view, and containing body fluids, a compact improved shark screen 10 should become a standard item of issue carried by persons who might possibly be vulnerable to a shark attack.

The improved shark screen is fabricated from a sheet of a thin film material which lends itself to being compactly stored in a small package by vacuum packaging techniques. A thin film material having the properties of polyethylene terephthalate commercially marketed under the trade name of "Mylar" by the E. I. du Pont de Nemours and Company of Wilmington, Del. has been found to be most suitable. Its three thousandths of an inch thickness is coated first, with an aluminizing layer to act as a radar reflector and second, with a black polyester to present a dull finish. This thin film laminate dimensioned as described below permits the vacuum packaging of the improved shark screen into a size conveniently carried in a shirt pocket.

A slightly tapered section 11 of Mylar about 50 inches in length is bonded unto a nearly hemispherical section 12 along a seam 13. The transition from the tapered section to the hemispherical section is continuous so as not to create any ridges or protuberances which might invite investigation by a nearby shark.

At the opposite end of the tapered section, an annular collar 14 is bonded around the open mouth of the tapered section. The annular collar has a double wall thickness to define an internal annular chamber. A valve stem **14*a*** allows the collar to be inflated by the disaster victim. The valve stem optionally is of the type used on commercial life vests or is merely a piece of tubing and a biased clamp. Lung power alone inflates the collar to provide a few pounds buoyancy and the collar now orients the shark screen in a vertical position. The inflated collar also presents a semi-stiff rim which holds the tapered section and hemispherical section open.

A short sleeve 15 is bonded onto the upper edge of the annular collar and is provided with a number of equidistantly spaced eyelets. A drawstring 16 is strung through the eyelets and when pulled tight, the inside of the shark screen is hidden from view.

Figure 3:
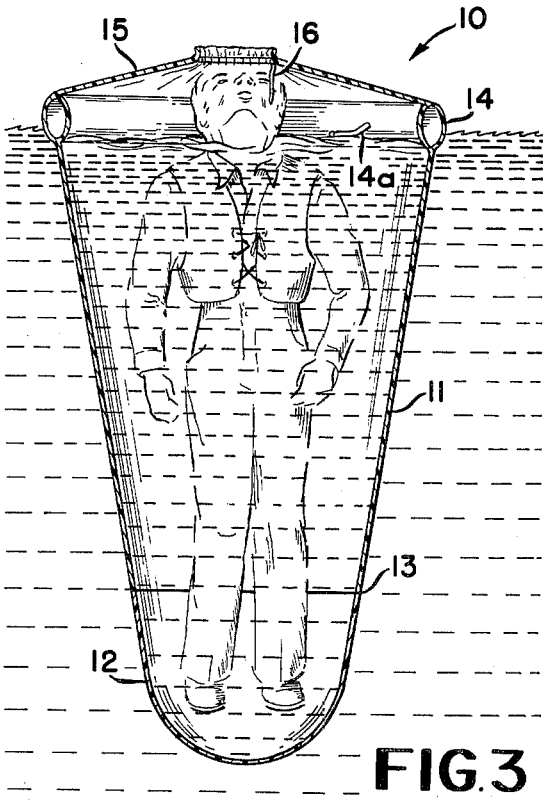
FIG. 3 shows the shark screen completely deployed and a disaster victim safe from menacing sharks.

As soon as the disaster victim is in the water, the vacuum packed "Mylar" shark screen 10 is pulled from a pocket. Since the victim's life jacket provides sufficient buoyancy, it is a relatively simple matter to quickly unfold the shark screen and enter it. Inflating annular collar 14 gives shape to the shark screen and orients it in an upright position. Repeatedly dipping the collar beneath the water's surface fills the screen and gives it a smooth continuous surface. The semirigid rim created by the inflated collar aids in forming the smooth outer contour which is free of any attention getting projections. The continuous envelope made by tapered section 11 and hemispherical section 12 prevents any body fluids from leaking into the surrounding water. When drawstring 16 is drawn tight, the occupant is hidden by sleeve 15 from sharks that may be in the near vicinity. Noting FIG. 3, the tied sleeve lowers the above water profile and does not create sharp corners or protuberances. The greater part of any waves that may wash over the screen run off the sleeve. The buoyancy of the life vest and the annular collar has been found to be sufficient to hold the victim's head above water. Optionally, the head may stick out from sleeve 15 when the drawstring is tightened about the neck.

Obviously, many modifications and variations of the present invention are possible in the light of the above teachings, and, it is therefore understood that within the scope of the disclosed inventive concept, the invention may be practiced otherwise than as specifically described.

What is claimed is:

1. In an apparatus for reducing the probability of shark attack an improvement therefor is provided comprising:

means for defining a cone-shaped envelope having a smooth continuous contour free from sharp corners and protuberances, the envelope is dimensioned and is integrally formed to ensure that body fluids are retained therein to completely contain a man;

means carried on the defining means for pneumatically distending to an annular shape to position the defining means to assume the smooth continuous contour and for buoyantly orientating it in an upright position, the distending and orientating means is dimensioned to lie in the water-air interface and not overly project above it and is provided with a valve stem to permit its inflation, the degree of such inflation is such as to provide only a few pounds buoyancy to allow the filling of the cone-shaped envelope with water and to reduce the above-water profile;

means connected to the distending and orientating means for flexibly closing the cone-shaped envelope, the distending and orientating means and the closing means are fabricated from a 3 mil thin film material to allow portability on the person and the outside of the defining means, the distending and orientating means, and the covering means are firstly coated with an aluminizing layer to act as a radar reflector and secondly with a black polyester to give the apparatus a dull appearance to reduce its attraction to sharks; and means mounted in the flexibly closing means for drawing it together thereby closing the cone-shaped envelope and hiding a disaster victim therein, the closing means is provided with a number of equidistantly spaced eyelets and the drawing means is a drawstring extending through the eyelets for further reduction of the above-water profile and to hide the occupant of the apparatus.

* * * * *